US006582096B1

(12) United States Patent
Searer

(10) Patent No.: US 6,582,096 B1
(45) Date of Patent: Jun. 24, 2003

(54) HANGER RAIL AND LIGHTING FIXTURE

(75) Inventor: Floyd A. Searer, Elkhart, IN (US)

(73) Assignee: Fas Industries, Inc., Elkhart, IN (US)

( * ) Notice: Subject to any disclaimer, the term of this patent is extended or adjusted under 35 U.S.C. 154(b) by 3 days.

(21) Appl. No.: 09/592,978

(22) Filed: Jun. 13, 2000

Related U.S. Application Data

(63) Continuation of application No. 09/276,675, filed on Mar. 26, 1999.

(30) Foreign Application Priority Data

Apr. 2, 1998 (FR) ..... 98 04115

(51) Int. Cl.[7] ..... F21V 33/00

(52) U.S. Cl. ..... 362/253; 211/123; 211/105.1; 362/217

(58) Field of Search ..... 211/123, 105.1; 362/253, 217

(56) References Cited

U.S. PATENT DOCUMENTS 1,947,969 A * 2/1934 Browne
3,384,244 A * 5/1968 Falek
3,685,662 A * 8/1972 Varon et al. ..... 211/105.1
3,784,023 A * 1/1974 Varon et al. ..... 211/105.1
4,379,324 A * 4/1983 Thompson ..... 362/253
4,760,929 A * 8/1988 Fedorchak ..... 211/123
5,421,059 A * 6/1995 Leffers, Jr. ..... 362/253 X

* cited by examiner

*Primary Examiner*—Laura K. Tso
(74) *Attorney, Agent, or Firm*—R. J. Lasker, Esq.

(57) ABSTRACT

A hanger rod for supporting clothes hangers, wherein an elongated rod including a slot extends along the upper longitudinal surface of the elongated rod; at least one hanger rail mounted within the slot at least at one predetermined position therein and in noncontacting relationship with the surface of the elongated rod; and at least one hanger supported on the hanger rail to prevent substantial contact of the hanger with the surface of the hanger rod, thereby reducing the frictional engagement between the at least one hanger and the surface of the hanger rod. The elongated rod may include a lighting fixture mounted therein and emitting light at least from both end portions of the elongated rod and/or from a slot extending along the bottom of the elongated rod. At least one hanger stop may be fixed at a predetermined position within the slot in the hanger rail for the purpose of segregating the hangers and preventing hangers from slipping from the elongated rod in the event it is tilted with respect to the horizontal.

15 Claims, 2 Drawing Sheets

HANGER RAIL AND LIGHTING FIXTURE

This application is a continuation application of application Ser. No. 09/276,675, filed Mar. 26, 1999.

BACKGROUND OF THE INVENTION

1. Field of the Invention

This invention relates to a combination of a hanger rod and lighting fixture and more particularly to such apparatus with provision for: (1) enabling easy movement of the hangers along the hanger rod; (2) preventing the surface of the hanger rod from being scratched or damaged by movement of the hangers along the rod; (3) preventing hangers from slipping off the hanger rod when the hanger rod is tilted; and (4) for providing light from at least the end portions of the hanger rod, and from a slit extending along the length of the underside of the hanger rod.

2. Related Art

U.S. Pat. No. 3,384,224 entitled "Anti-Friction Support Bar" to Falek describes teflon beads positioned around the circumference of a covering aluminum or steel pipe to permit a hook member of a clothes hanger to slide easily and silently along the pipe.

U.S. Pat. No. 3,685,662 entitled "Hang Rail Construction and Bracket Therefor" to Varon et al. discloses a plastic strip member, having low friction for metal, and is engaged in a channel of the hang rail to enable hangers to slide without scratching the surface of the hang rail.

U.S. Pat. No. 2,827,555 entitled "Illuminated Clothes Closet Fixture" to Wooley describes an illuminated clothes closet fixture including a light source and a garment-supporting or garment-hanger supporting rail located below the light source.

U.S. Pat. No. 5,421,059 entitled "Traverse Support Rod" to Leffers, Jr. discloses a light element mounted within a decorative cap of an elongated member, such as a hanger or traverse rod.

There remains the need in hanger rail apparatus to provide a simple and inexpensive means to prevent the hanger rod from being scratched with movement of hangers along the hanger rail, preventing the hangers from falling from the hanger rod with tilting of the hanger rod from being parallel to the floor, and to provide adequate lighting in the vicinity of the hanger rail from a light source located within the hanger rail.

SUMMARY OF THE INVENTION

The present invention is directed to the combination of a hanger rod and a lighting fixture mounting within the hanger rail and comprising a rod, which may be anodized or covered with a wood veneer, having a hanger rail mounted in a groove on top of the rod for preventing the surface of the rod from being scratched or scored by clothes hangers as they are moved along the rod. A fluorescent bulb, or alternatively an incandescent bulb(s), is housed inside the rod for lighting the end of the hanger assembly as well as areas between the ends, if desired. Hanger stops affixed at desired locations along the hanger rail enable the hangers to be separated from one another and also to enable the hanger assembly to be positioned at an angle with respect to horizontal and prevent clothes hangers from falling off the hanger rod.

While the preferred embodiment of the invention is to utilize the hanger rod and lighting fixture in combination, it is readily apparent that these two features of the invention are also capable of being used alone, depending on which of the characteristic features of the invention is desired for a particular application.

An object of the invention is to provide a hanger rod enabling the easy movement of hangers along the hanger rod by reducing the frictional drag between the hangers and the surface of the hanger rod and to reduce or eliminate scratching of the surface of the hanger with movement of the hangers along the hanger rod.

A feature of the invention is a hanger rail extending along all, or selected portions, of the longitudinal axis of the hanger rod and upon which the hanger necks are supported separate from the surface of the hanger rod. An associated feature of the invention is that movement of the hangers along the hanger rail reduces or eliminates scratching of the surface of the hanger rod with movement of the hangers along the hanger rod.

An advantage of the invention is that movement of the hangers along the hanger rod, and particularly with heavy clothing hung thereon, is facilitated.

Another object of the invention is to prevent slippage of the hangers along the hanger rod, thereby enabling the hanger rod to be tilted with respect to the floor surface.

Another feature of the invention is the provision of movable hanger stops which are attached at desirable positions along the hanger rail by a screw-type mechanism thereby restricting movement of the hangers along the hanger rod.

Another advantage of the invention is that movement of the hangers along the hanger rod may be restricted as desired.

And still another object of the invention is the provision of simply operated means to separate hangers hanging from the hanger rod.

And still another feature of the invention is the provision of movable hanger stops which are attached at desirable positions along the hanger rail by a screw-type mechanism, thereby enabling the hangers to be separated from one another.

And still another advantage of the invention is that hangers may be separately positioned along the hanger rod.

And yet another object of the present invention is to provide light emanating from the hanger rod.

And yet another feature of the invention is the inclusion of a light source within the hanger rod, whereby light emanates from each end of the hanger rod, when desired, and along the entire length thereof.

And yet another advantage of the invention is that areas around the ends and the bottom of the hanger rod may be illuminated by a light source located within the hanger rod.

And yet another feature of the invention is that either fluorescent or incandecent light bulbs may be inserted in the hanger rod.

BRIEF DESCRIPTION OF THE DRAWINGS

The above objects, features and advantages of the invention are readily perceived from the following description of the best mode of carrying out a preferred embodiment of the invention when taken in consideration of the following drawings, wherein.

DETAILED DESCRIPTION

Figure 1A:
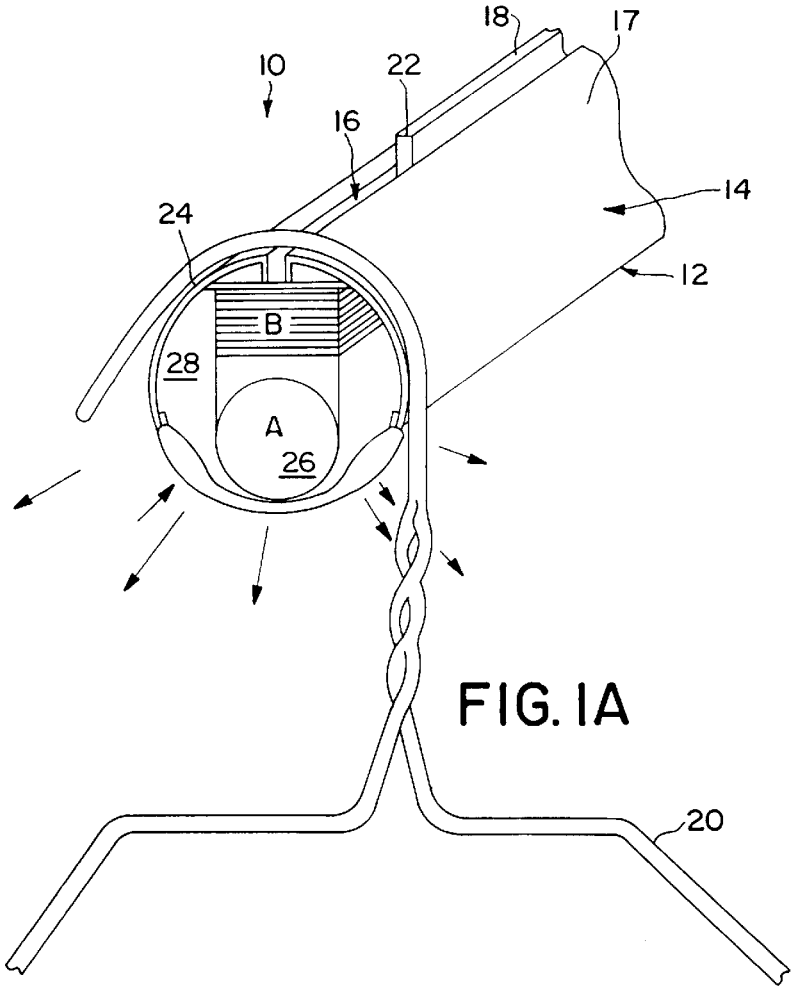
FIG. 1A is a perspective view of the combined hanger rod and lighting fixture with the hanger rail positioned to support hangers and a light source mounted within the hanger rod in accordance with a preferred embodiment of the invention.

As shown in FIG. 1A, hanger rod and light fixture assembly 10 comprises hanger rod 12 made of wood or metal with an optional veneer surface 14 and including a rail groove 16 extending along the longitudinal axis of the upper surface 17 of the hanger rod 12. Hanger rail 18 is shown fixed in hanger rail groove 16 and extends above upper surface 17 so that the hanger necks (shown in FIG. 3) are separated from the surface 17 of the hanger rod 12. Such a distance may be, for example, approximately ¼ inch. Although the extension of the hanger rail 18 above the upper surface 17 of hanger rod 12 is not critical, it must be sufficient so that the neck support of the hangers that are to be supported on the hanger rail 18 are free to move along the hanger rail without significant frictional engagement of the hangers with the hanger rod 12. In FIG. 1 hanger 20 is shown resting on the upper surface 17 of hanger rod 12 and spaced from the end 22 of hanger rail 18. Such a spacing allows the hangers to be positioned and retained at the end of hanger rod 12 by the engagement of support neck 24 with the surface 14 of the hanger 20. This is an alternate use of the hanger rod 12, that is, without the hanger necks 24 being supported on the hanger rail 18.

Figure 1B:
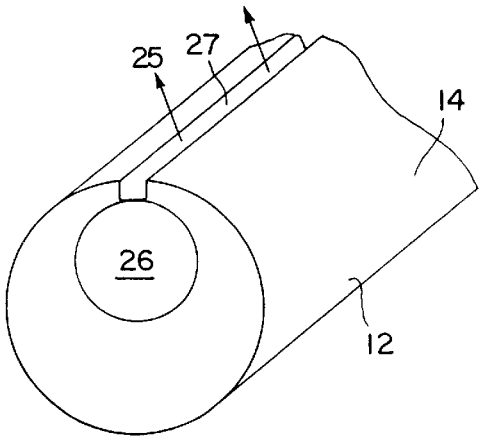
FIG. 1B is a bottom view of the hanger showing the slit along the longitudinal axis thereof to allow light to emanate therefrom.

Continuing with FIG. 1A, a portion of lamp bulb 26 is shown at the end portion 28 of hanger rod 12. Lamp bulb 26 may comprise a series of individual light bulbs or a fluorescent bulb extending essentially the length of the hanger rod 12 so that light 25 may project from both ends of the hanger rod 12. If desired, a slit or opening 26 may be formed along the bottom surface of the longitudinal axis of hanger rod 12 (as shown in FIG. 1B) to provide illumination along the entire length of the bottom of the hanger rod 12. It is understood that the ballast **26*b* for the fluorescent light may be located within hanger rod 12, or may be remotely located outside of the hanger rod 12** and connected to the fluorescent light by suitable wiring.

In the case where individual light bulbs are used, one light bulb may be positioned at each end of the hanger rod 12 and several light bulbs may be positioned in spaced relation along the inside bottom of the hanger rod 12 and immediately within a bottom slit 27 therein.

Figure 2A:
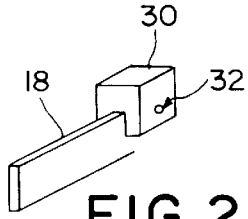
FIG. 2A illustrates a hanger stop mounted to the hanger rail.

In FIG. 2A, hanger stop 30 is shown mounted to hanger rail 18 and fixed in a desired location thereon by a screw-like mechanism, such as set screw 32. Hanger stop 30 may be made of chromed steel or plated brass or even plastic. The fastening means may also comprise a winged screw in lieu of the set screw. It is evident that individual hanger stops 30 may be positioned in any desired positions along hanger rail 18 so that groups of individual hangers 20 may be separated as desired. Additionally, it may be desired to place hanger rod 12 at other than a horizontal relation with respect to the floor, and in such cases hanger stops 30 afford a convenient means of preventing individual hangers 20 from slipping off the hanger rod 12.

Figure 2B:
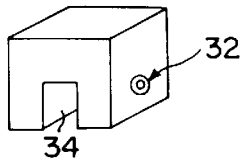
FIG. 2B shows a perspective view of an embodiment of a hanger stop.

FIG. 2B shows a perspective view of hanger stop 30 with slot 34 extending the full length along the bottom of the hanger stop. Set screw or other easily used fastening means extends within slot 34 to engage hanger rail 18 and fix the hanger stop at a desired location on the hanger rail as described above.

Figure 3:
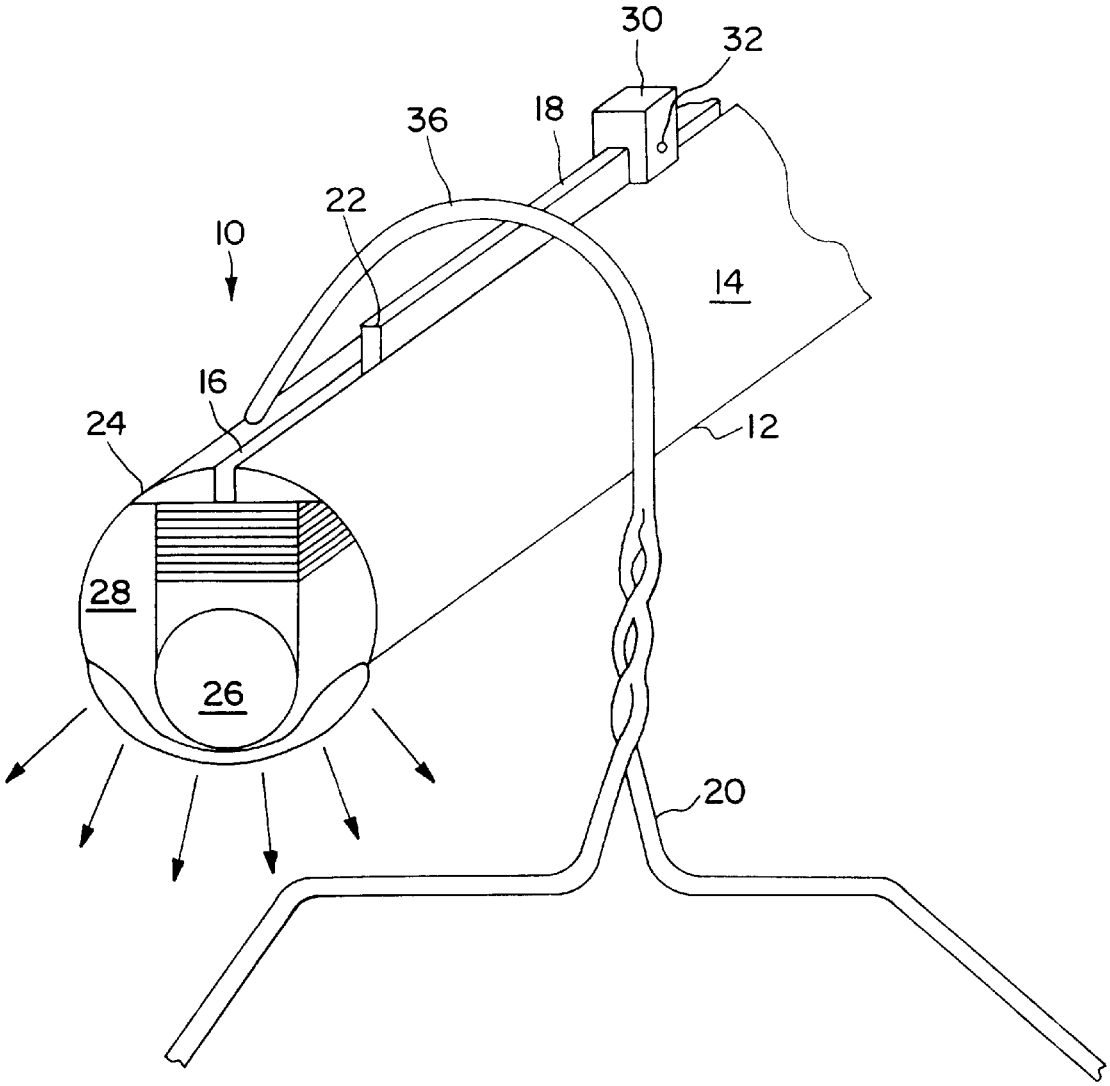
FIG. 3 is a perspective view of of the combined hanger rod and lighting fixture with the hanger rail supporting a hanger and a hanger stop mounted on the hanger rail to restrict movement of the hanger.

FIG. 3 illustrates the combined hanger rod and lighting fixture 10 with the neck 36 of a hanger 20 positioned on top of hanger rail 18 so that neck 36 is relatively free of contact with surface 14 of the hanger rod. Obviously, a number of hanger rods 20 may be so positioned on hanger rail 18.

FIG. 3 also illustrates a hanger stop 30 mounted to and fixed to hanger rail 18 by means of a set screw 32 or other type of screw fastening means. The purpose of hanger stop 30 is to separate a hanger rod 20 from other hanger rods (not shown) on hanger rail 18 as well as to prevent hangers 20 from slipping along hanger rail 18, particularly when hanger rod 10 is tilted from the horizontal axis **12*a*–12*b*. Such a non-horizontal configuration of the combined hanger rod and lighting fixture may be desired to better display the garments hanging from individual hanger rods 20 as opposed to having them located side-by-side with the combined hanger rod and lighting fixture 10** positioned horizontally.

Notwithstanding the foregoing description, it is apparent that the invention may be modified to be used without hanger rail 18, thereby enabling the hanger neck supports 24 to rest on a portion of the upper surface 17 of hanger rod 12. This modification is useful when the hanger neck supports have a significantly larger radius than the radius of hanger rod 12, thereby preventing binding of the hanger neck supports 24 with movement along hanger rod 12.

Therefore, it is desired that the present invention not be limited to the embodiments specifically described, but that it include any and all such modifications and variations that would be obvious to those skilled in this art. It is my intention that the scope of the present invention should be determined by any and all such equivalents of the various terms and structure as recited in the following annexed claims.

What is claimed is:

1. A hanger rod for supporting clothes hangers comprising:

an elongated rod including a slot extending along the upper longitudinal surface of the elongated rod;

at least one hanger rail mounted within said slot at least one predetermined position therein having an upper rail surface and in noncontacting relationship with the surface of said elongated rod;

at least one hanger resting on said upper rail surface to prevent substantial contact of said hanger with the adjacent surface of the hanger rod, thereby reducing the frictional engagement between said at least one hanger and the adjacent surface of said hanger rod; and at least one hanger stop fixed at a predetermined position on said hanger rail and said at least one hanger comprising a plurality of hangers and said at least one hanger stop separating said plurality of hangers into at least one desired group of hangers;

wherein said elongated rod is adapted to be positioned at least one of horizontally and at an angle tilted with respect thereto.

2. The hanger rod according to claim 1, wherein said hanger rod is tilted from horizontal and said at least one hanger stop prevents a desired group of said hangers from slipping off said hanger rail.

3. The hanger rod according to claim 1, wherein said at least one hanger stop is fixed to said hanger rail by means of a mechanism that is attached to said hanger rail.

4. The hanger rod according to claim 3, wherein said mechanism is a set screw.

5. The hanger rod according to claim 3, wherein said mechanism is a winged screw.

6. A hanger rod for supporting clothes hangers, comprising:

an elongated rod including a slot extending along the upper longitudinal surface of the elongated rod;

at least one hanger rail mounted within said slot at least at one predetermined position therein having an upper rail surface and in noncontacting relationship with the surface of said elongated rod;

at least one hanger resting on said upper rail surface to prevent substantial contact of said hanger with the adjacent surface of said hanger rod, thereby reducing the frictional engagement between said at least one hanger rod and the adjacent surface of said hanger rod;

wherein said elongated is adapted to be positioned at least one of horizontally and at an angle tilted with respect thereto; and said elongated rod including a lighting fixture mounted therein and emitting light at least from both end portions of said elongated rod.

7. The combined hanger rod and lighting fixture according to claim 6, wherein said lighting fixture is a fluorescent light and said elongated rod includes an opening extending along the bottom of the longitudinal axis of said elongated rod so that light is cast from said opening.

8. The combined hanger rod and lighting fixture according to claim 7, wherein a ballast for said fluorescent light is remotely located from said elongated hanger rod.

9. The combined hanger rod and lighting fixture according to claim 6, wherein said lighting fixture is at least one incandescent light source and said elongated rod includes an opening extending along the bottom of the longitudinal axis of said elongated rod so that light is emitted from said opening.

10. The combined hanger rod and lighting fixture according to claim 6, further comprising at least one hanger stop fixed at a predetermined position on said hanger rail and said at least one hanger comprising a plurality of hangers and said at least one hanger stop separating said plurality of hangers into at least one desired group of hangers.

11. The hanger rod according to claim 10, wherein said hanger rod is tilted from horizontal and said at least one hanger stop prevents a desired group of said hangers from slipping off said hanger rail.

12. The hanger rod according to claim 1, wherein said at least one hanger stop is fixed to said hanger rail by means of a mechanism that is attached to said hanger rail.

13. The hanger rod according to claim 12, wherein said mechanism is a set screw.

14. The hanger rod according to claim 12, wherein said mechanism is a winged screw.

15. A combined hanger rod and lighting fixture, comprising:

an elongated rod including a slot extending along the bottom longitudinal surface of the rod; and said elongated rod including a lighting fixture mounted therein and casting light through said slot and from both end portions of said elongated rod.

* * * * *